US010207416B2

(12) United States Patent
Secondi

(10) Patent No.: US 10,207,416 B2
(45) Date of Patent: Feb. 19, 2019

(54) HIGH PERFORMANCE ROTARY CUTTING APPARATUS FOR PROFILES WITH STRAIGHT EDGES

(71) Applicant: SANDVIK INTELLECTUAL PROPERTY AB, Sandviken (SE)

(72) Inventor: Jacques Joseph Philippe Secondi, Monsteroux-Millieu (FR)

(73) Assignee: Sandvik Hyperion AB, Stockholm (SE)

( * ) Notice: Subject to any disclaimer, the term of this patent is extended or adjusted under 35 U.S.C. 154(b) by 183 days.

(21) Appl. No.: 15/301,418

(22) PCT Filed: Apr. 3, 2014

(86) PCT No.: PCT/IB2014/000618
§ 371 (c)(1),
(2) Date: Oct. 3, 2016

(87) PCT Pub. No.: WO2015/150851
PCT Pub. Date: Oct. 8, 2015

(65) Prior Publication Data

US 2017/0113365 A1 Apr. 27, 2017

(51) Int. Cl.

| | |
|---|---|
| ***B26D 1/40*** | (2006.01) |
| ***B26F 1/38*** | (2006.01) |
| *B26D 7/26* | (2006.01) |

(52) U.S. Cl.
CPC ..... *B26D 1/405* (2013.01); *B26D 7/265* (2013.01); *B26F 1/384* (2013.01); *B26D 7/26* (2013.01); *B26D 2007/2692* (2013.01)

(58) Field of Classification Search
CPC ..... B26D 1/405; B26D 2007/2692
See application file for complete search history.

(56) References Cited

U.S. PATENT DOCUMENTS

| | | | | |
|---|---|---|---|---|
| 3,380,328 A | | 4/1968 | Martin | |
| 3,552,251 A | * | 1/1971 | Neff | B26D 5/32 83/299 |
| 4,014,234 A | * | 3/1977 | Spengler | B26D 1/405 83/162 |
| 4,630,514 A | * | 12/1986 | Ohmori | B23D 35/001 83/341 |
| 5,720,210 A | * | 2/1998 | Okahashi | B26D 1/405 83/342 |

(Continued)

FOREIGN PATENT DOCUMENTS

| | | |
|---|---|---|
| DE | 2211118 A1 | 9/1973 |
| EP | 0204866 A1 | 12/1986 |

(Continued)

*Primary Examiner* — Sean Michalski

(57) ABSTRACT

The present invention relates to a rotary cutting apparatus for cutting a web of material, including a cutting unit rotatably mounted on a support, a rotary cutter rotatably disposed in the cutting unit, the rotary cutter having a longitudinal axis, and at least one cutting edge disposed on the rotary cutter, wherein the at least one cutting edge is orientated at an angle to the longitudinal axis of the cutter. The cutting unit being counter orientated to the feed direction of the web by an adjustable angle equal to the cutting edge angle, less than the cutting edge angle or greater than the cutting edge angle.

20 Claims, 13 Drawing Sheets

(56) References Cited

U.S. PATENT DOCUMENTS

| | | | | |
|---|---|---|---|---|
| 5,918,518 | A * | 7/1999 | Kobayashi | B26D 1/405 83/100 |
| 7,901,271 | B2 * | 3/2011 | Buta | B24B 3/363 451/28 |
| 2002/0088322 | A1 * | 7/2002 | Pollock | B26D 1/405 83/37 |
| 2003/0121381 | A1 * | 7/2003 | Buta | B23D 25/12 83/37 |
| 2007/0044613 | A1 | 3/2007 | Cohn | |
| 2012/0036973 | A1 | 2/2012 | Eisemann | |
| 2018/0015622 | A1 * | 1/2018 | Kent | B26D 1/405 |

FOREIGN PATENT DOCUMENTS

| | | | |
|---|---|---|---|
| EP | 288182 | A1 | 10/1988 |
| EP | 0204868 | A1 | 9/1991 |
| EP | 1445079 | A2 | 8/2004 |
| EP | 1484145 | A2 | 12/2004 |
| JP | S61090898 | A | 5/1986 |
| RU | 2468910 | C2 | 12/2012 |
| RU | 2478458 | C2 | 4/2013 |
| RU | 2507037 | C2 | 2/2014 |
| WO | 2009151059 | A1 | 12/2009 |

* cited by examiner

HIGH PERFORMANCE ROTARY CUTTING APPARATUS FOR PROFILES WITH STRAIGHT EDGES

RELATED APPLICATION DATA

This application is a § 371 National Stage Application of PCT International Application No. PCT/IB2014/000618 filed Apr. 3, 2014.

TECHNICAL FIELD

The present disclosure relates to a carbide rotary cutter apparatus for cutting a web of material, including a cutting unit rotatably mounted on a base and a rotary cutter rotatably disposed in the cutter unit. At least one cutting edge of the rotary cutter is orientated at an angle to the longitudinal axis of the cutter and the cutting unit is adjustably counter-orientated to the cutting edge angle and feed web direction.

BACKGROUND

In order to perpendicularly cut a web of material, the most common solution is to have a carbide blade that is fixed on a steel cylinder. There are different kinds of shapes for the blades: for example, a carbide tip brazed on a steel support; a square piece of carbide with sharpened angles; and a carbide blade with two or more useful cutting edges.

These solutions have some drawbacks. The lifetime of the blades is quite short, i.e., from one week to one month. Moreover, since the entire edge length of the blade needs to touch the counter-knife at the same time, high forces are needed to get the cut. This creates shocks and vibrations and damages the counter-knife. The blade(s) also need to be adjusted in height and to be aligned prior to cutting in order to get a good cut. However, the price of such an arrangement is a main advantage.

It is known to angle the knife edge on the rotary cutter, see U.S. Pat. No. 3,380,328, EP288182A1 and U.S. Patent Application Publication No. 2007/0044613. However, because the knife or cutting edge is fixed to the rotary cutter, the angle of the cut on the web is not adjustable, i.e., a plurality of interchangeable, different angled knife edge/rotary cutters are needed to achieve different angles of cuts. Moreover, such devices merely orient the cut via the angled cutting edge, but not the cutting unit itself. Also, the rotation axis of the cutter is limited to being positioned in a predetermined orientation to the feed direction of the web.

The foregoing, as well as the following detailed description of the embodiments, will be better understood when read in conjunction with the appended drawings. It should be understood that the embodiments depicted are not limited to the precise arrangements and instrumentalities shown.

DETAILED DESCRIPTION

Figure 1:
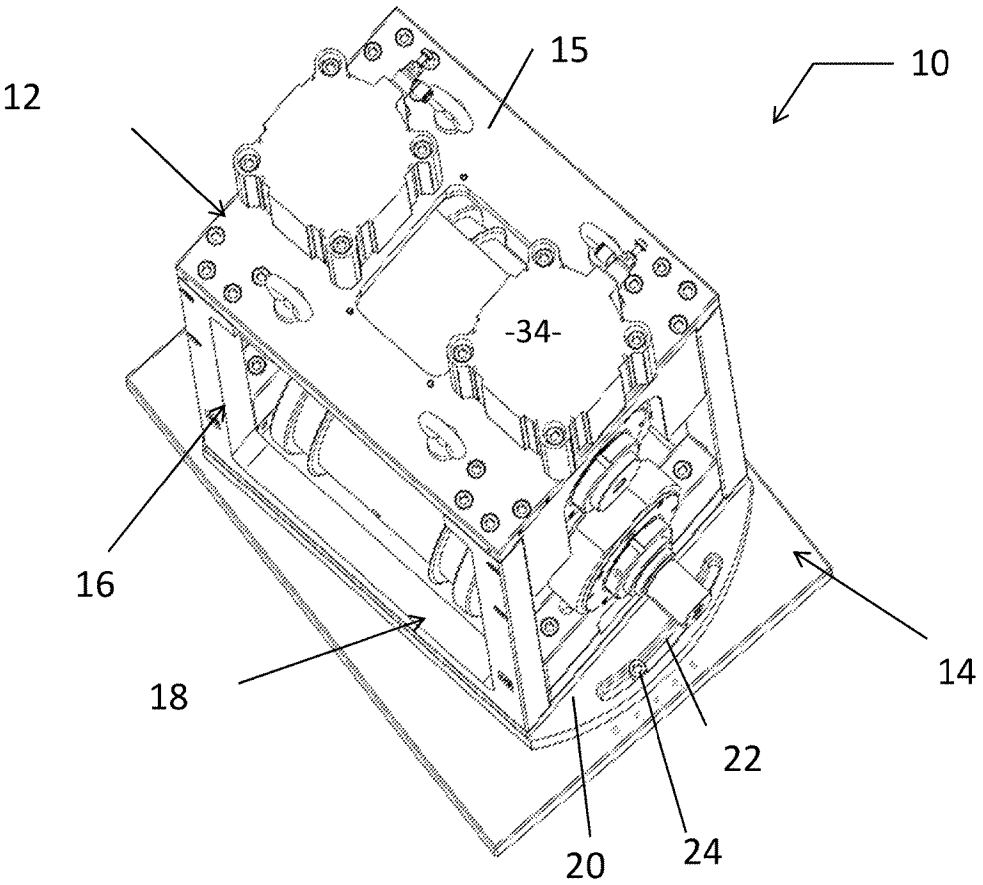
FIG. 1 is a perspective view of an embodiment of a rotary cutting apparatus.
Figure 2:
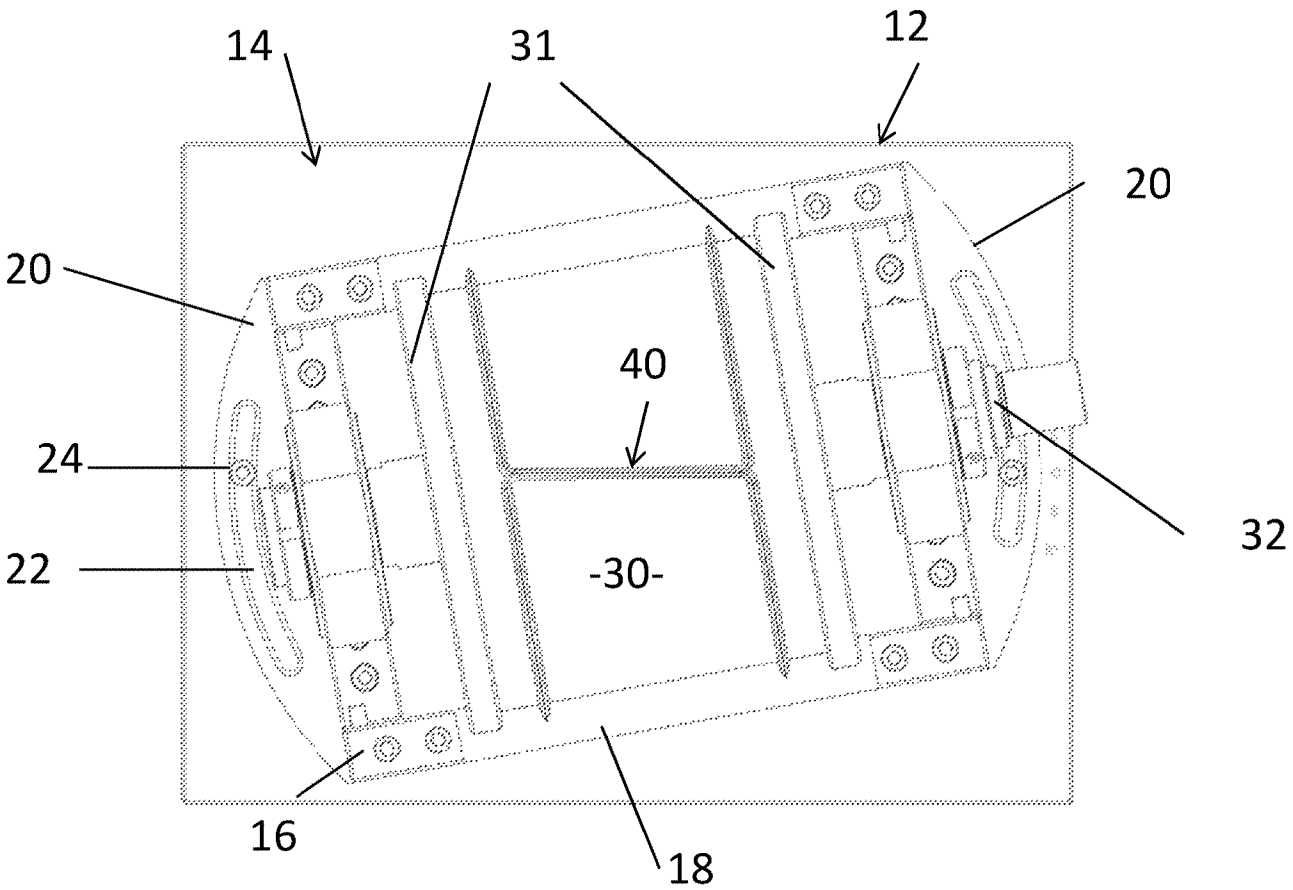
FIG. 2 is a top view of the rotary cutter of the rotary cutting apparatus of FIG. 1, with the top plate thereof removed.

Referring to FIG. 1, a rotary cutting apparatus 10 for cutting a web of material 26 (FIG. 3) includes a cutting unit 12 rotatably mounted on a support 14. Cutting unit 12 has a top plate 15, frame 16 and base 18. As shown in FIGS. 1 and 2, base 18 has a pair of opposed side portions 20, each including a curved slot 22. Each slot 22 receives a respective post 24 mounted on support 14. Posts 24 slide within slots 22 to enable cutting unit 12 to be rotated about support 14 enabling the cutting unit to be positioned in a predetermined orientation to the feed direction F (FIG. 3) of the web. It should be appreciated that although the position of cutting unit 12 can be adjusted with respect to support 14, the feed direction of the web material remains perpendicular to support 14.

Figure 7:
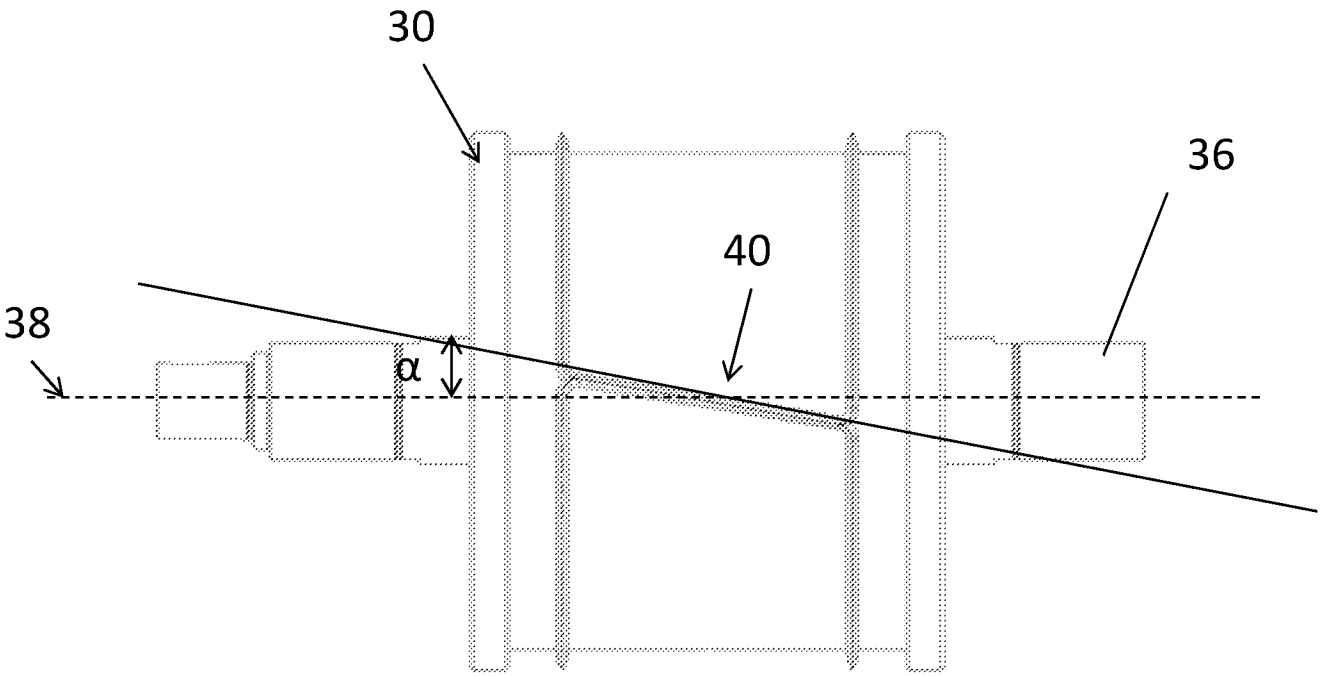
FIG. 7 is a top view of the rotary cutter.

Referring to FIG. 2, a rotary cutter 30 is disposed in cutter unit 12 and mounted to frame 16 via bearings 32. Rotary cutter 30 can be a helical cut drum, i.e., the cutting blade or knife is mounted along a helical angle on the drum. Accordingly, only a relatively small portion of the knife is shearing the material at one time as the drum rotates creating a straight cut. A driving system (not shown), such as an electrical drive, gears, pulleys and belt, or other kinds of couplings, communicates with an arbor 36 (FIG. 7) of rotary cutter 30 to rotate the same about its longitudinal axis 38 (FIG. 7).

Figure 3:
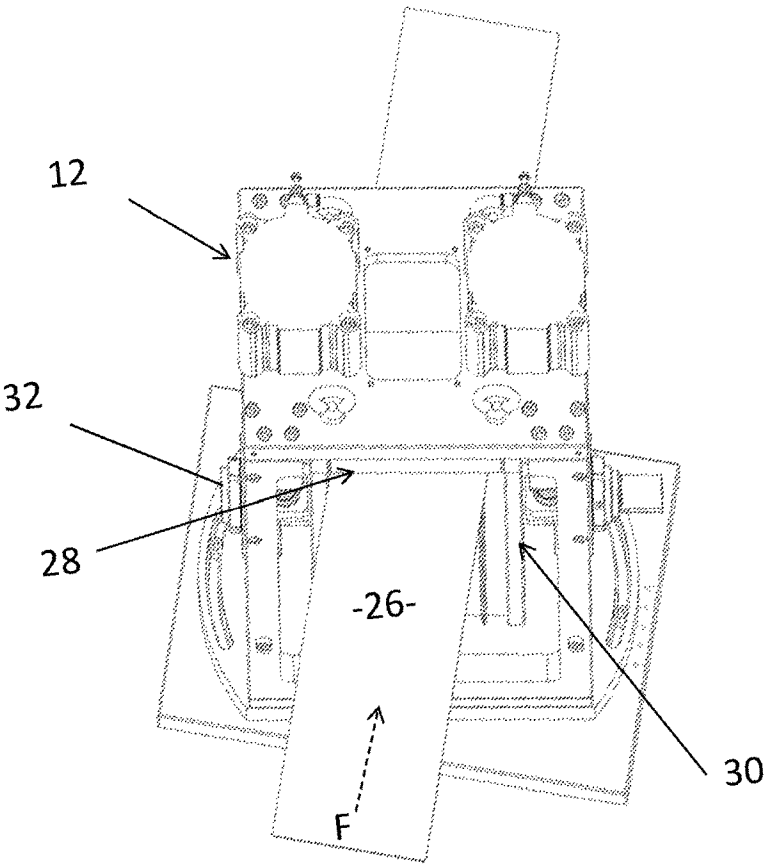
FIG. 3 is a perspective view of the rotary cutting apparatus with a web of material fed therethrough.
Figure 4:
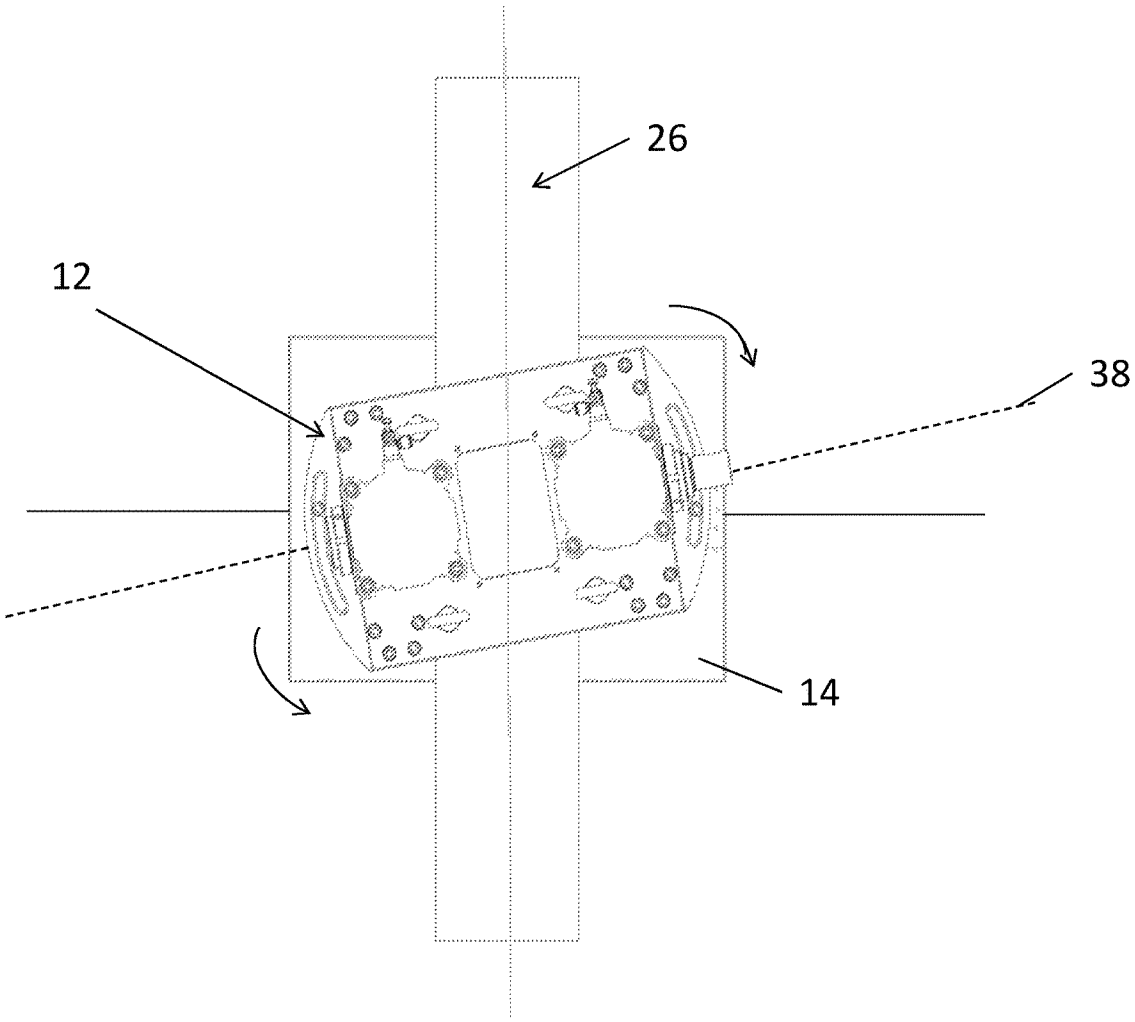
FIG. 4 is a top view of the rotary cutting apparatus of FIG. 3.
Figure 9A:
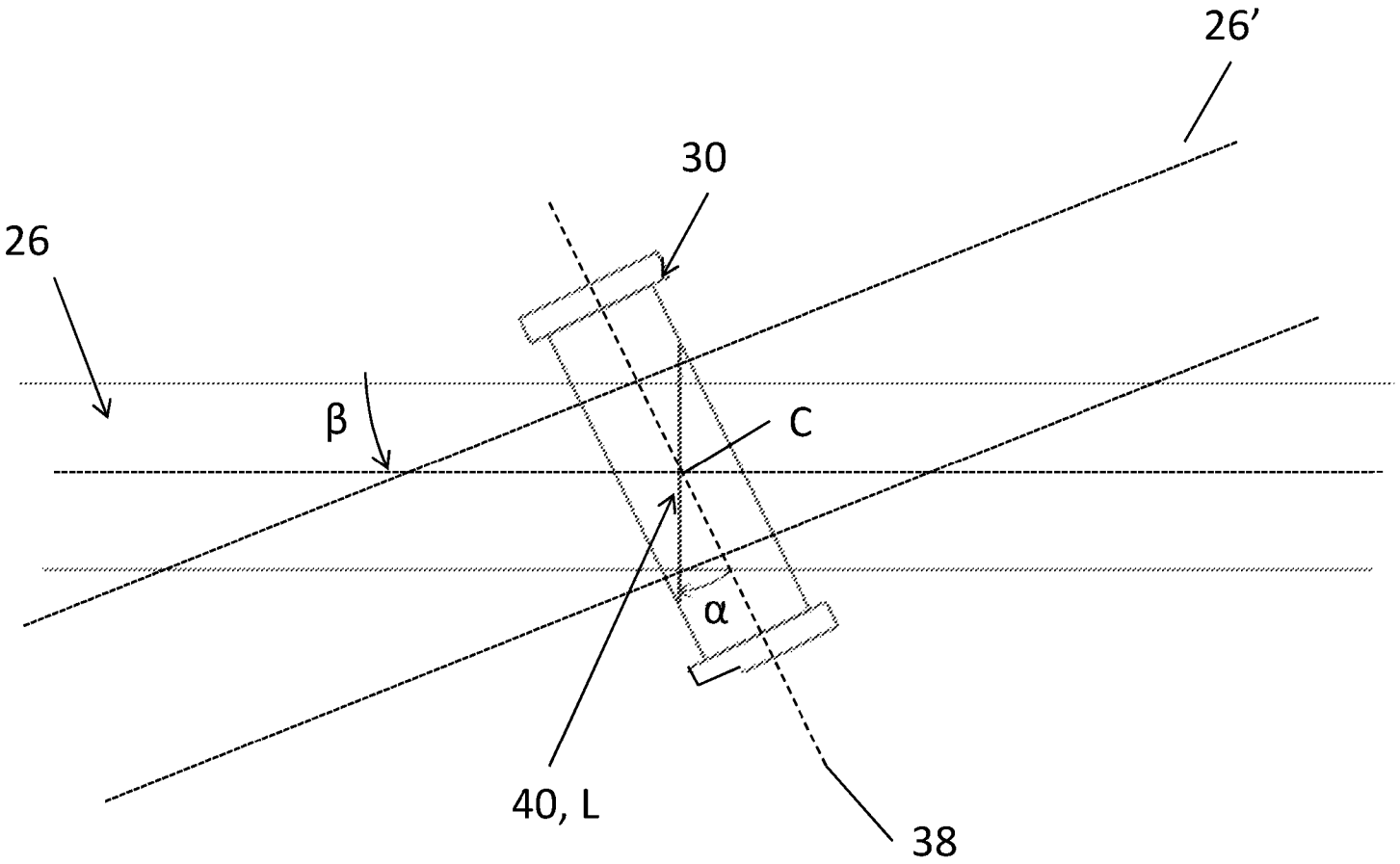
FIG. 9A is an enlarged view of the angular relationship of the rotary cutter, cutting edge and web of material in one example orientation.
Figure 9B:
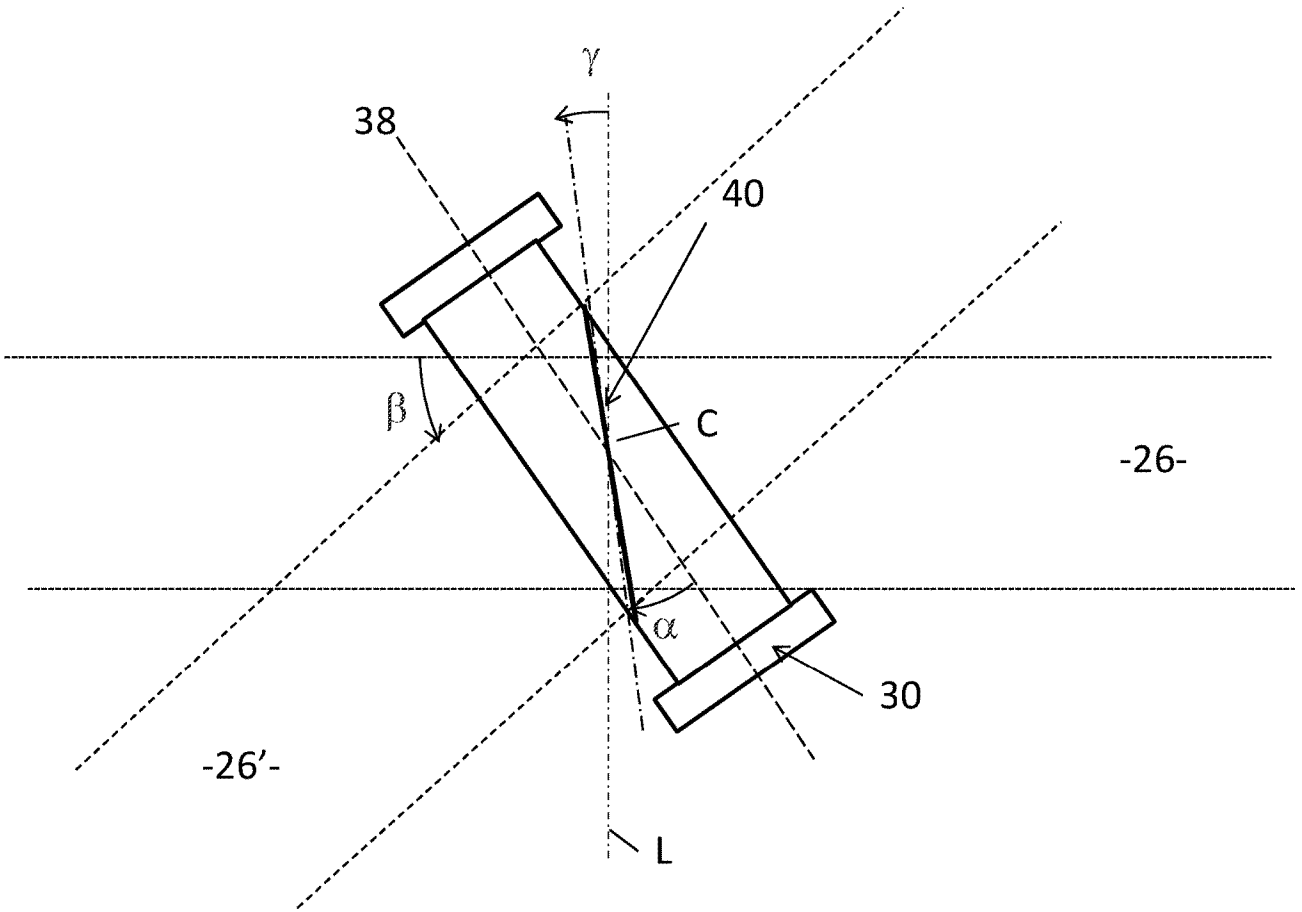
FIG. 9B is an enlarged view of the angular relationship of the rotary cutter, cutting edge and web of material in another example orientation.
Figure 9C:
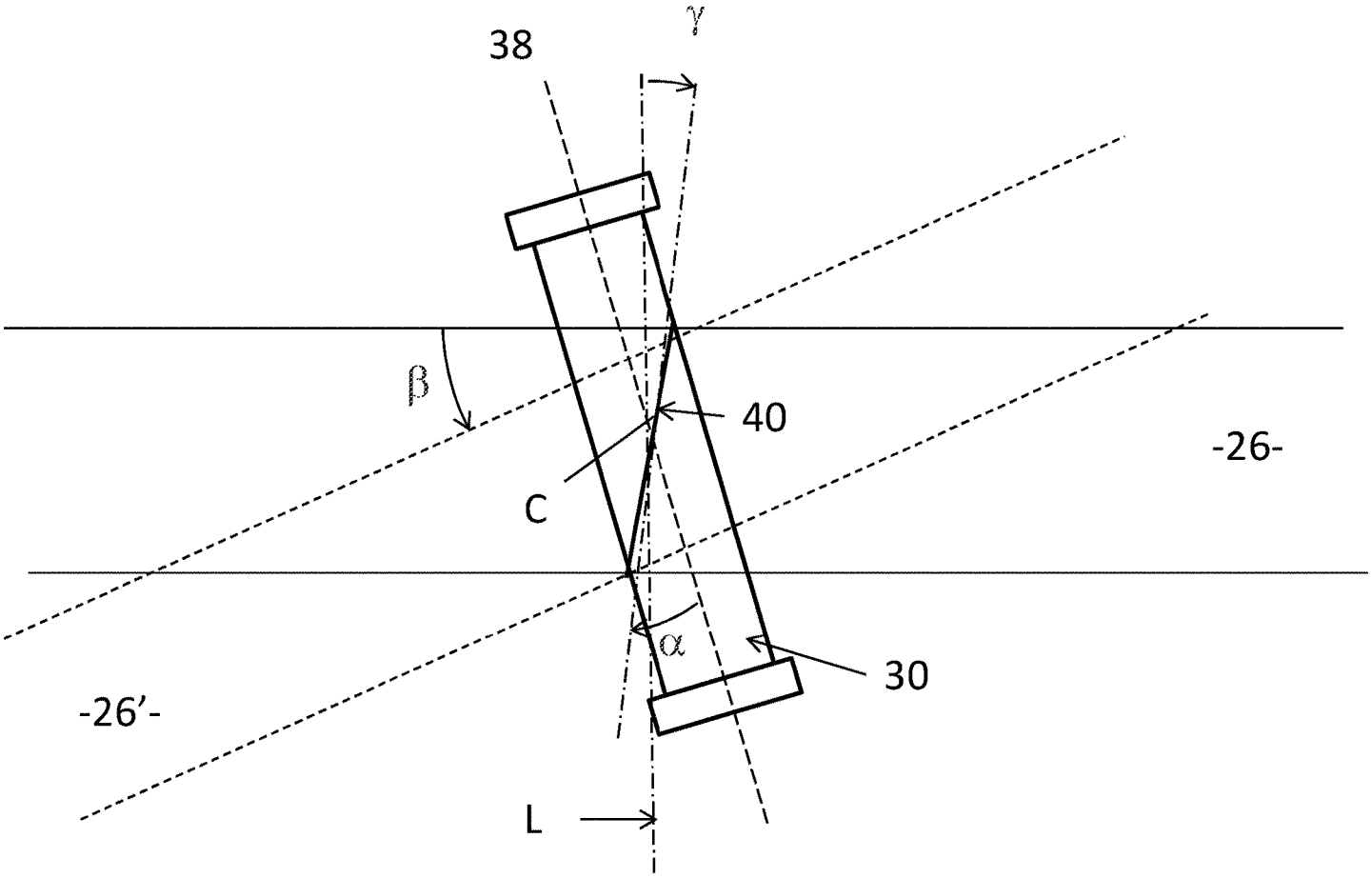
FIG. 9C is an enlarged view of the angular relationship of the rotary cutter, cutting edge and web of material in yet another example orientation.

Referring to FIGS. 3 and 4, a web of material 26 passes between rotary cutter 30 and a rotating anvil 28 also disposed in cutting unit 12. Web 26 can be a nonwoven material used in hygiene, medical and diaper products. The web is a continuous web that is cut in discrete pieces, or from which a trim portion is removed. As rotary cutter 30 rotates about a longitudinal axis 38, the web of material is fed between it and anvil 28. The rotation of cutter 30 translates to a rotation of the anvil by friction between bearing surfaces 29 (FIG. 5) and bearer rings 31 (FIG. 5) of the rotary cutter and the web 26 is fed through by the machine. As shown and as will be described further herein, the cutting unit 12 and rotary cutter 30 can be orientated at an angle to web 26, for example, preferably about 0.5° to about 15°. Hence, the cutting unit 12 may be oriented so that the longitudinal axis 38 through the rotary cutter 30 forms a predetermined angle with the feed direction of the web 26, as can be viewed from reference point C (FIGS. 9A-9C).

Figure 5:
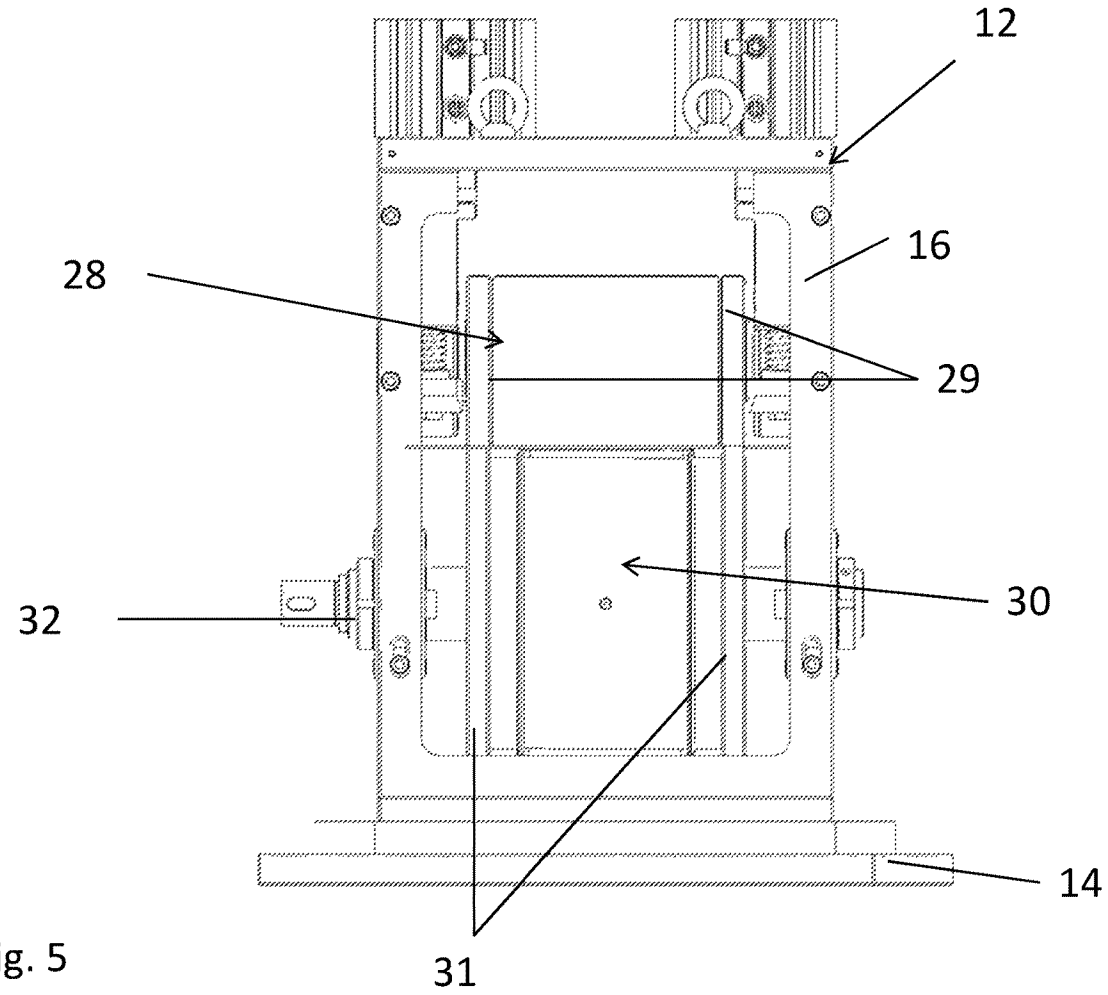
FIG. 5 is a side view of the rotary cutting apparatus of FIG. 1.
Figure 6:
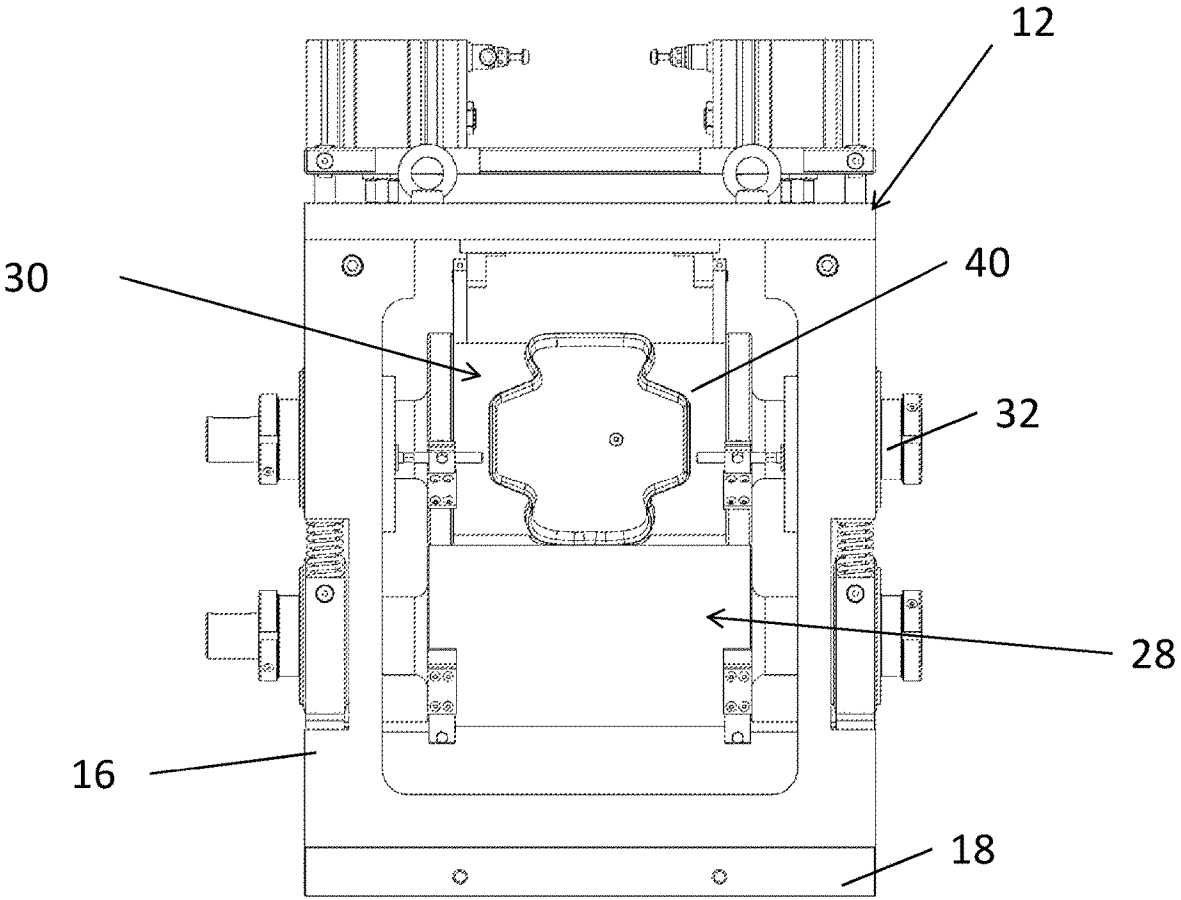
FIG. 6 is a side view of another embodiment of the rotary cutting apparatus.

Referring to FIG. 5, rotary cutter 30 is positioned below anvil 28. Alternatively, as shown in FIG. 6, rotary cutter 30 can be placed above anvil 28. A loading system 34 (FIG. 1)

for applying a force on the cutting edge can be air cylinders, hydraulic cylinders or any other equivalent mechanical system. Although shown as pushing on the anvil, the loading system can act on the anvil or rotary cutter. The loading system can be placed on the same side as the actuated roller, i.e., in a push configuration or on the other, opposite side, i.e., in a pull configuration. It should also be appreciated that anvil 28 is free in rotation. It can be also synchronized with the cutter by gears, pulleys or step-motors.

Cutter 30 and anvil 28 can be made of cemented carbide for improved reliability and wear resistance. Cemented carbide, as used herein, is defined as a hard, carbide phase, 70 to 97 wt-% of the composite and a binder phase. Tungsten carbide (WC) is the most common hard phase and cobalt (Co) the most common binder phase. These two materials form the basic cemented carbide structure. It should be appreciated that many other types of cemented carbide can be used for the rotary cutter. Alternatively the cutter or the anvil can be made partially or totally of other materials like tool steel, high speed steels or like ceramic-metal composites. These materials can be produced through known metallurgy or powder metallurgy methods.

Referring again to FIG. 2, at least one cutting edge 40 is disposed on rotary cutter 30. As will be discussed further herein, cutting edge 40 can have a variety profiles, for example as shown in FIG. 6, depending on the desired end cut and can be formed integrally with and extends outwardly from the rotor surface. Edge 40 is ground in relation to bearer rings 31 and can be higher or lower by few micrometers or at same height thereto. This parameter depends mainly on the materials to be cut, but it is ground so that there is no adjustment and it improves greatly the reliability and the achievable performance.

Figure 8:
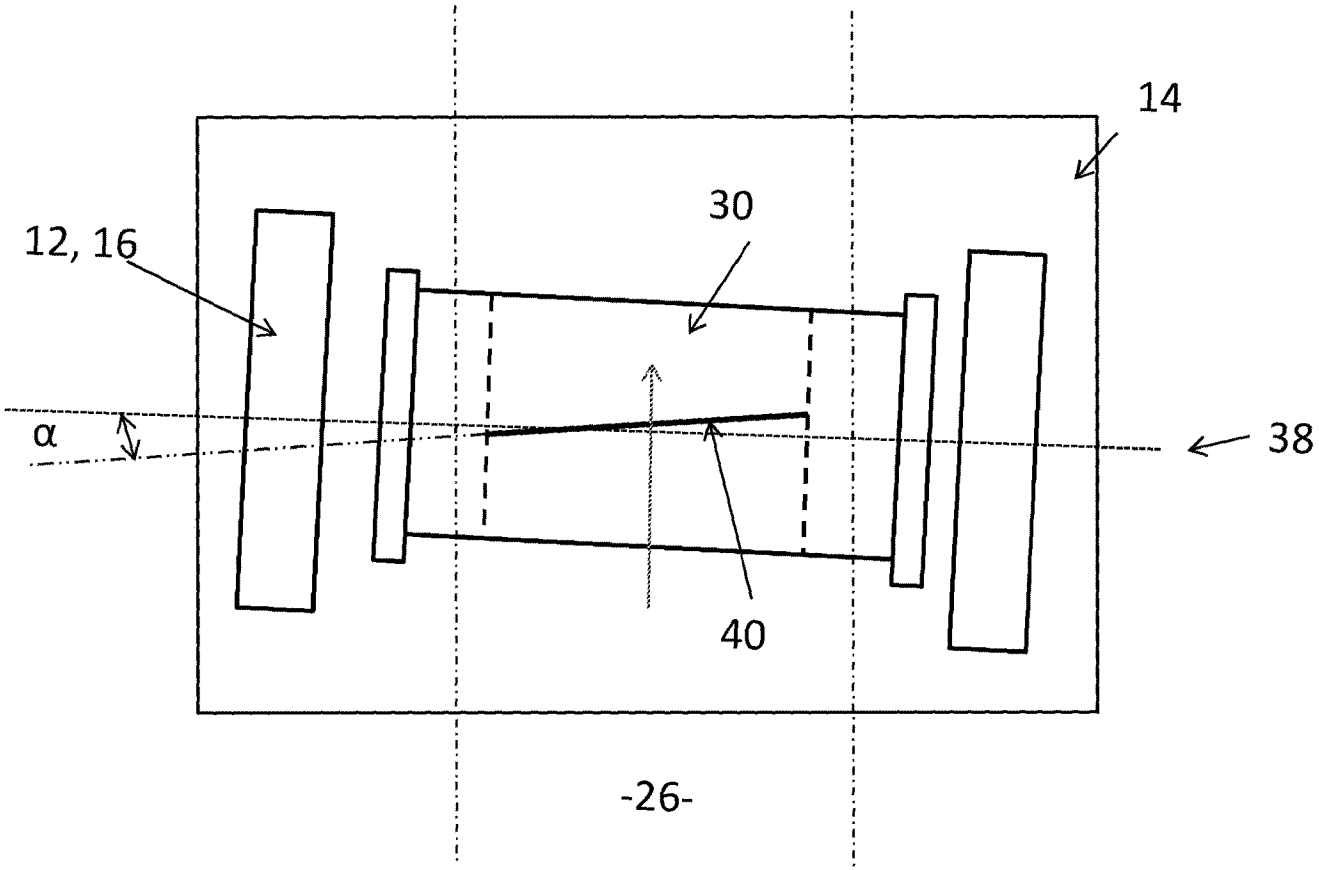
FIG. 8 illustrates the angles of orientation of the rotary cutter, cutting unit and web of material.

As shown in FIGS. 7-8, cutting edge 40 is orientated at a cutting edge angle $\alpha$ to the longitudinal rotation axis 38 of the cutter. Angle $\alpha$ is from about 0.5° to about 15°. Referring to FIGS. 9A-9C, the longitudinal rotation axis 38 of the rotary cutter 30 is counter orientated, i.e., rotated in an opposite direction, with the feed direction of the web material 26 by an adjustable angle $\beta$. As can be seen more clearly by a web position 26', this adjustable counter angle $\beta$ can also be from about 0.5 to 15°.

If a cut perfectly parallel to the web direction is desired, there is no change of the edge orientation of the cutter unit orientation. Referring to FIG. 9A, in this example, angle $\alpha$ is equal to angle $\beta$, to produce the straight cut. Accordingly to this example, if the angle $\alpha$ of the cutting edge 40 with respect to longitudinal axis 38 is pre-set at −5°, then the cutting unit can be rotated about support 14 to an angle $\beta$ of 5.

If another type of product profile is wanted, i.e., wherein adjustable angle $\beta$ is greater than angle $\alpha$, the position of cutting unit 12 can be adjusted in relation to the support 14 in order to obtain another desired cutting angle of edge 40. For example, as shown in FIG. 9B, in order to produce a cut oriented with an angle of 2° to the web 26, as shown as angle $\gamma$, which is the angle between cutting edge 40 and a line L perpendicular to web 26, where angle $\alpha$, of the cutting edge is pre-orientated on the rotary cutter at an angle of −5°, then the cutting unit angle should be counter orientated with respect to the web by an adjustable angle of 7°, i.e., the sum of these the two angles. Thus, $\beta$=720 gives an orientation of a $\gamma$ angle 2° counter-clockwise from line L.

Referring to FIG. 9C, in an example where it is desired to have an orientation whereby adjustable angle $\beta$ is less than cutting edge angle $\alpha$, i.e., a cut oriented clockwise by an angle $\gamma$ of −2° to the web 26 and angle $\alpha$, of the cutting edge is pre-orientated on the rotary cutter at an angle of −5°, then the cutting unit angle should be counter orientated with respect to the web by a $\beta$ angle of 3°, i.e., the sum of these the two angles.

It should be appreciated that the above angle values are exemplary and the particular value of the pre-determined angle between the cutting edge 40 and rotational axis 38 can be chosen from any number of values in the range as discussed above. Moreover, as described above cutting unit 12 can be rotated either clockwise or counterclockwise to affect the angle values.

Figure 10:
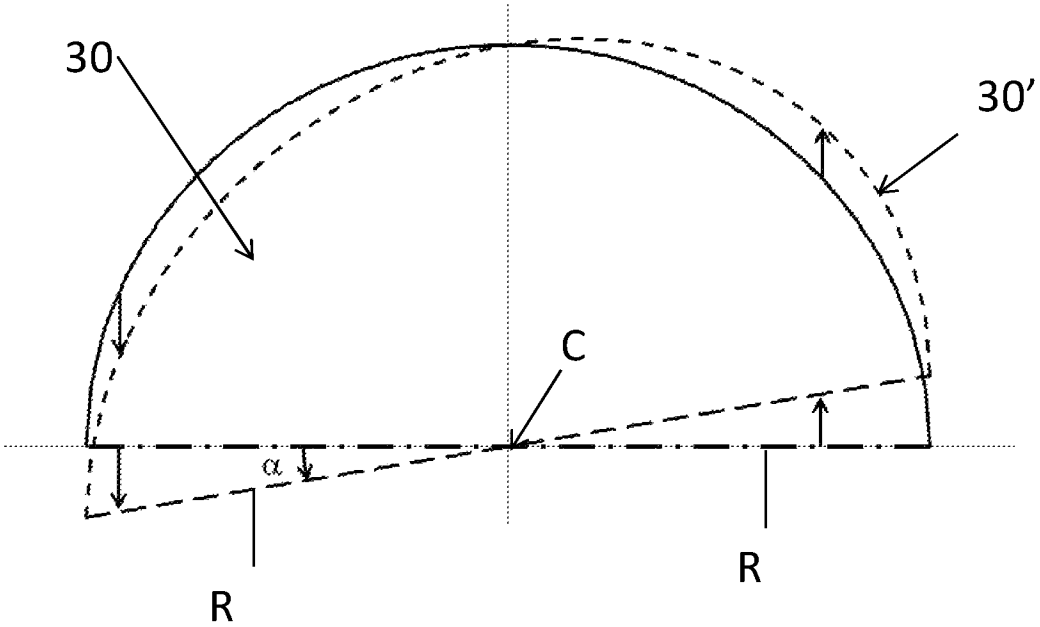
FIG. 10 is a partial cross-section of the rotary cutter illustrating a rotation of the radius thereof.

The present disclosure can be further described in the case of a profile that incorporates a radius R in its features. As shown in FIG. 10, each point of the circular line is moved in a web direction by a positive or negative value that depends on the position on each side of the axis 38, as represented by point C (also shown in FIG. 9A). When a diameter parallel to cutter axis 38 is moved by angle $\alpha$ it creates a shift in machine direction that depends on the position along the cutter's axis. This shift that can be positive or negative is used also to move the points of the radius vertically, shown by arrows, the same value as the diameter. It is thus possible to generate any type of profile using this kind of geometrical transformation.

Figure 11B:
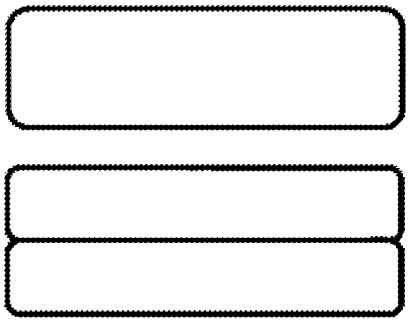
FIGS. 11A-11C are sample cuts made by the rotary cutter apparatus of the present disclosure.
Figure 11A:
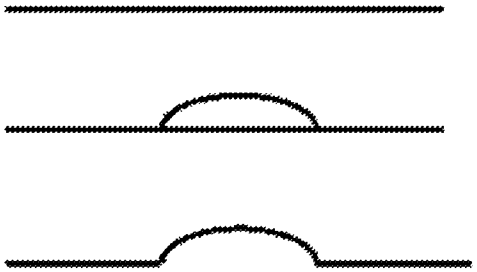
Figure 11C:
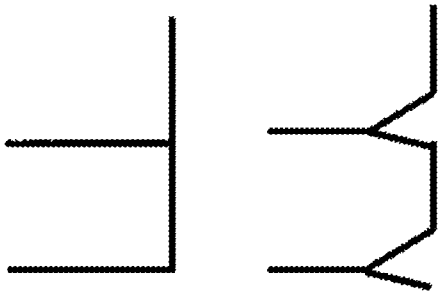

As described above, the edge itself on the rotary die cutter is not straight: it is designed with an angle of 0.5° to 15°. The cutting unit 12 is counter oriented with approximately the same angle. However, it should be appreciated that some adjustments are possible to take process parameters into account. Accordingly, as described supra, cutting unit 12 can be rotated about support 14, via slots 22 and post 24. As a consequence the edge length does not cut everywhere at the same time, but the resulting cut on the web is straight and perpendicular to the cutting direction. This arrangement provides a carbide rotary die cutter and its cutting unit that are designed to produce a long straight cut Referring to FIGS. 11A-11C, depending on the profile of the ground edge, straight cuts with ombilical cuts (FIG. 11A) can be produced. Likewise, it could be applied to rectangular shapes with or without common edges, as shown in FIG. 11B. It also could be useful for ear cuts or when there are long edges, with or without common edges, as shown in FIG. 11C.

Accordingly, the present invention can be used to cut straightly two diapers or in combination with other profile features of nonwovens. It might be used also to cut wipes or tissues for hygienic and non-hygienic applications, carton, paper, thin metal sheets, thin sheets of plastic materials, reinforced or not like composite materials.

The present arrangement eliminates the need for adjustment of the edge before cutting because the cutting parameters are produced when the cutter is ground. The cutting forces are reduced and the cut is smooth and with limited level of vibrations. Also, the lifetime of the anvil is dramatically increased Although the present embodiment(s) has been described in relation to particular aspects thereof, many other variations and modifications and other uses will become apparent to those skilled in the art. It is preferred therefore, that the present embodiment(s) be limited not by the specific disclosure herein, but only by the appended claims.

The invention claimed is:

1. A rotary cutting apparatus for cutting a web of material, the cutting apparatus comprising:

a support;

a cutting unit movably disposed on the support;

a rotary cutter rotatably disposed in the cutting unit, the rotary cutter having a longitudinal axis; and at least one cutting edge disposed on the rotary cutter, wherein the at least one cutting edge is orientated at an angle relative to the longitudinal axis of the rotary cutter, wherein the cutting unit is adjustably orientated relative to a feed direction of the web by an adjustable angle that is in a direction opposite to that of the angle at which the at least one cutting edge is orientated, and wherein the cutting unit is rotatable relative to the support about a rotation axis that is perpendicular to the longitudinal axis and that is located at a position along the length of the cutting edge where, in a view down the rotation axis, the longitudinal axis of the cutter intersects the cutting edge.

2. The rotary cutting apparatus of claim 1, wherein the cutting edge angle is of about 0.5° to of about 15° .

3. The rotary cutting apparatus of claim 1, wherein the web of material is angled with respect to the longitudinal axis of the rotary cutter.

4. The rotary cutting apparatus of claim 1, wherein the cutting unit is rotatably mounted on the support to adjust the orientation of the adjustable angle of the cutting unit to the feed direction of the web of material.

5. The rotary cutting apparatus of claim 4, wherein the cutting unit is counter-orientated to the longitudinal axis of the rotary cutter by about 0.5° to about 15° .

6. The rotary cutting apparatus of claim 1, wherein the adjustable angle is equal to the cutting edge angle.

7. A rotary cutting unit for cutting a web of material, the cutting unit comprising:

a frame;

a rotary cutter rotatably disposed in the frame, the rotary cutter having a longitudinal axis; and at least one cutting edge disposed on the rotary cutter, wherein the at least one cutting edge is orientated at an angle to the longitudinal axis of the cutter, wherein the cutting unit is adjustably orientated relative to a feed direction of the web of material by an adjustable angle that is in a direction opposite to that of the angle at which the at least one cutting edge is orientated, and wherein the cutting unit is rotatable relative to the support about a rotation axis that is perpendicular to the longitudinal axis and that is located at a position along the length of the cutting edge where, in a view down the rotation axis, the longitudinal axis of the cutter intersects the cutting edge.

8. The rotary cutting unit of claim 7, wherein the cutting edge angle is of about 0.5° to of about 15° .

9. The rotary cutting unit of claim 7, wherein the web of material is angled with respect to the longitudinal axis of the rotary cutter.

10. The rotary cutting unit of claim 7, wherein the frame is rotatably mounted on a support of a rotary cutting apparatus and the feed direction of the web of material is perpendicular to the rotation axis.

11. The rotary cutting unit of claim 7, wherein the cutting unit is counter-orientated to the longitudinal axis of the rotary cutter by the adjustable angle that is of about 0.5° to of about 15° .

12. The rotary cutting unit of claim 7, wherein the adjustable angle is equal to the cutting edge angle.

13. A method for cutting a profile from a web of material using a rotary cutting unit including a frame, a rotary cutter rotatably disposed in the frame, the rotary cutter having a longitudinal axis, and at least one cutting edge disposed on the rotary cutter, wherein the at least one cutting edge is orientated at an angle to the longitudinal axis of the cutter, wherein the cutting unit is adjustably orientated relative to a feed direction of the web of material by an adjustable angle that is in a direction opposite to that of the angle at which the at least one cutting edge is orientated, and wherein the cutting unit is rotatable relative to the support about a rotation axis that is perpendicular to the longitudinal axis and that is located at a position along the length of the cutting edge where, in a view down the rotation axis, the longitudinal axis of the cutter intersects the cutting edge, the method comprising:

rotatably adjusting a position of the cutting unit to be at the adjustable angle;

rotating the rotary cutter about the longitudinal axis to cut the profile from the web of material.

14. The rotary cutting apparatus of claim 1, wherein the adjustable angle is less than the cutting edge angle.

15. The rotary cutting apparatus of claim 1, wherein the adjustable angle is greater than the cutting edge angle.

16. The rotary cutting unit of claim 7, wherein the adjustable angle is less than the cutting edge angle.

17. The rotary cutting unit of claim 7, wherein the adjustable angle is greater than the cutting edge angle.

18. The rotary cutting apparatus of claim 1, wherein the cutting unit has a base with opposed side portions each with a curved slot to receive a respective post mounted on the support, and wherein the post is slidable within the slots to rotate the cutting unit relative to the support about the rotation axis.

19. The rotary cutting unit of claim 7, wherein the cutting unit has a base with opposed side portions each with a curved slot to receive a respective post mounted on the support, and wherein the post is slidable within the slots to rotate the cutting unit relative to the support about the rotation axis.

20. The method of claim 13, wherein the edge length does not cut everywhere at the same time, but the resulting cut on the web is straight and perpendicular to the cutting direction.

* * * * *